US008981964B2

(12) United States Patent
Matsumura

(10) Patent No.: US 8,981,964 B2
(45) Date of Patent: Mar. 17, 2015

(54) DRIVING SUPPORTING DEVICE

(75) Inventor: Takeshi Matsumura, Chofu (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 156 days.

(21) Appl. No.: 13/000,831

(22) PCT Filed: Mar. 11, 2009

(86) PCT No.: PCT/JP2009/054684
§ 371 (c)(1),
(2), (4) Date: Dec. 22, 2010

(87) PCT Pub. No.: WO2010/103636
PCT Pub. Date: Sep. 16, 2010

(65) Prior Publication Data

US 2011/0115646 A1 May 19, 2011

(51) Int. Cl.
*G08G 1/095* (2006.01)
*G08G 1/0967* (2006.01)
*G08G 1/16* (2006.01)

(52) U.S. Cl.
CPC .... *G08G 1/096716* (2013.01); *G08G 1/096758* (2013.01); *G08G 1/096783* (2013.01); *G08G 1/16* (2013.01)
USPC ..... 340/907; 340/929; 701/70; 701/96

(58) Field of Classification Search
CPC ..... G08G 1/096758; G08G 1/096716; G08G 1/096783; G08G 1/16
USPC ..... 340/907, 929; 701/70, 96, 117–119; 455/344–346
See application file for complete search history.

(56) References Cited

U.S. PATENT DOCUMENTS 7,398,076 B2 7/2008 Kubota et al.
2001/0034575 A1* 10/2001 Takenaga et al. ..... 701/96
(Continued)

FOREIGN PATENT DOCUMENTS

CN 1804931 A 7/2006
JP 2000 99889 4/2000
(Continued)

OTHER PUBLICATIONS

International Search Report issued Apr. 7, 2009 in PCT/JP09/54684 filed Mar. 11, 2009.
(Continued)

*Primary Examiner* — Tai T Nguyen
*Assistant Examiner* — Ojiako Nwugo
(74) *Attorney, Agent, or Firm* — Oblon, McClelland, Maier & Neustadt, L.L.P.

(57) ABSTRACT

In this driving supporting device, the light color change cycle of a prediction object traffic signal is acquired on the basis of the light color change cycle of a prediction basis traffic signal installed before the prediction object traffic signal, and the light color state of the prediction object traffic signal when the vehicle arrives at the prediction object traffic signal is predicted on the basis of the light color state of the prediction basis traffic signal and the light color change cycle of the prediction object traffic signal. Thus, since the light color change cycle of the prediction object traffic signal is acquired on the basis of the light color change cycle of the prediction basis traffic signal, it becomes possible to predict a light color state even in the case of a traffic signal which cannot transmit information indicating its light color change cycle.

6 Claims, 5 Drawing Sheets

(56) References Cited

U.S. PATENT DOCUMENTS

| | | | | |
|---|---|---|---|---|
| 2002/0070880 | A1* | 6/2002 | Dotson | 340/901 |
| 2003/0078718 | A1* | 4/2003 | Takenaga et al. | 701/96 |
| 2004/0158366 | A1 | 8/2004 | Dieterle | |
| 2005/0140523 | A1* | 6/2005 | Publicover | 340/907 |
| 2006/0009188 | A1* | 1/2006 | Kubota et al. | 455/344 |
| 2006/0055525 | A1* | 3/2006 | Kubota et al. | 340/461 |
| 2006/0055557 | A1* | 3/2006 | Lu | 340/907 |
| 2006/0095199 | A1* | 5/2006 | Lagassey | 701/117 |
| 2008/0030372 | A1* | 2/2008 | Lu | 340/929 |
| 2008/0071460 | A1* | 3/2008 | Lu | 701/93 |
| 2008/0253615 | A1* | 10/2008 | Kubota et al. | 382/104 |
| 2008/0266072 | A1* | 10/2008 | Suzuki | 340/438 |
| 2010/0070128 | A1* | 3/2010 | Johnson | 701/33 |
| 2011/0095906 | A1 | 4/2011 | Stählin | |

FOREIGN PATENT DOCUMENTS

| | | | |
|---|---|---|---|
| JP | 2003-217085 | A | 7/2003 |
| JP | 2003-294466 | A | 10/2003 |
| JP | 2005 115638 | | 4/2005 |
| JP | 2005 147884 | | 6/2005 |
| JP | 2007 170864 | | 7/2007 |
| JP | 2007-256196 | A | 10/2007 |
| JP | 2008 210066 | | 9/2008 |
| JP | 2008 293440 | | 12/2008 |
| WO | WO 03/077222 | A1 | 9/2003 |
| WO | WO 2009/027173 | A1 | 3/2009 |

OTHER PUBLICATIONS

English translation of International Preliminary Report on Patentability and Written Opinion of the International Searching Authority issued Oct. 27, 2011, in PCT/JP2009/054684.

Extended European Search Report issued Aug. 6, 2012 in European Patent Application No. 09841464.2.

Mariagrazia Dotoli, et al., "A signal timing plan formulation for urban traffic control", Control Engineering Practice, vol. 14, No. 11, XP027906101, Nov. 1, 2006, pp. 1297-1311.

* cited by examiner

DRIVING SUPPORTING DEVICE

TECHNICAL FIELD

The present invention relates to a driving supporting device which predicts the light color state of a traffic signal that a vehicle is due to pass.

BACKGROUND ART

Conventionally, there is known a driving supporting device which predicts the light color state of a traffic signal when a vehicle arrives at the traffic signal by acquiring the light color change cycle of the time-interlocked traffic signal by synchronizing the time information of the traffic signal that the vehicle is due to pass and the time information of a device mounted in the vehicle with each other using the time information acquired from a GPS (for example, refer to Patent Literature 1).

CITATION LIST

Patent Literature

Patent Literature 1: Japanese Unexamined Patent Application Publication No. 2005-147884

SUMMARY OF INVENTION

Technical Problem

In the driving supporting device described above, however, there is a problem in that it is difficult to predict the light color state regarding a traffic signal whose light color change cycle is not interlocked with a time or a traffic signal which cannot transmit information indicating its light color change cycle.

The present invention has been made in view of such a situation, and it is an object of the present invention to provide a driving supporting device capable of predicting the light color state even in the case of a traffic signal which cannot transmit information indicating its light color change cycle.

Solution to Problem

In order to achieve the above-described object, a driving supporting device related to the present invention is a driving supporting device which predicts a light color state of a first traffic signal that a vehicle is due to pass and is characterized in that it includes: a light color state acquisition means for acquiring a light color state of a second traffic signal installed before the first traffic signal; a light color change cycle acquisition means for acquiring the light color change cycle of the first traffic signal on the basis of the light color change cycle of the second traffic signal; and a light color state predicting means for predicting the light color state of the first traffic signal when the vehicle arrives at the first traffic signal on the basis of the light color state of the second traffic signal acquired by the light color state acquisition means and the light color change cycle of the first traffic signal acquired by the light color change cycle acquisition means.

In this driving supporting device, the light color change cycle of the first traffic signal is acquired on the basis of the light color change cycle of the second traffic signal installed before the first traffic signal, and the light color state of the first traffic signal when the vehicle arrives at the first traffic signal is predicted on the basis of the light color state of the second traffic signal and the light color change cycle of the first traffic signal. Thus, since the light color change cycle of the first traffic signal is acquired on the basis of the light color change cycle of the second traffic signal, it becomes possible to predict a light color state even in the case of a traffic signal which cannot transmit information indicating its light color change cycle. In addition, the light color state means a color state of a traffic signal which lights green, yellow, red, and the like, and the light color change cycle means a signal cycle of 1 cycle which changes from green to yellow, from yellow to red, and from red to green on the basis of predetermined rules.

In addition, it is preferable that the light color change cycle acquisition means acquires the light color change cycle of the first traffic signal on the basis of information regarding a time difference from the light color change cycle of the second traffic signal. According to this configuration, when the light color state of the first traffic signal changes in a state interlocked with the light color state of the second traffic signal, the light color change cycle of the first traffic signal can be correctly acquired.

In addition, it is preferable that a scheduled time calculating means for calculating a scheduled time at which the vehicle arrives at the first traffic signal is further provided and the light color state predicting means predicts the light color state of the first traffic signal at the scheduled time calculated by the scheduled time calculating means. According to this configuration, the light color state of the first traffic signal when the vehicle arrives at the first traffic signal can be correctly predicted.

In addition, it is preferable that the light color state acquisition means acquires the light color state of the second traffic signal and the duration of the light color state and the light color state predicting means predicts the light color state of the first traffic signal on the basis of the light color state of the second traffic signal and the duration of the light color state acquired by the light color state acquisition means and the light color change cycle of the first traffic signal acquired by the light color change cycle acquisition means. According to this configuration, even if the light color state of the second traffic signal does not change when the vehicle passes the second traffic signal, the light color state of the first traffic signal can be predicted.

In addition, it is preferable that the light color state acquisition means acquires the light color state of the second traffic signal on the basis of an image of the second traffic signal captured by a camera mounted in the vehicle. According to this configuration, the light color state of the second traffic signal can be acquired easily and reliably.

In addition, it is preferable to further include a driving support instructing means for giving an instruction to the vehicle, on the basis of the light color state of the first traffic signal predicted by the light color state predicting means, so that a predetermined driving support operation is performed when the vehicle arrives at the first traffic signal. According to this configuration, driving support when the vehicle arrives at the first traffic signal can be appropriately realized.

Advantageous Effects of Invention

According to the present invention, it is possible to predict a light color state even in the case of a traffic signal which cannot transmit information indicating its light color change cycle.

REFERENCE SIGNS LIST

1: driving supporting device

3: camera

Figure 1:
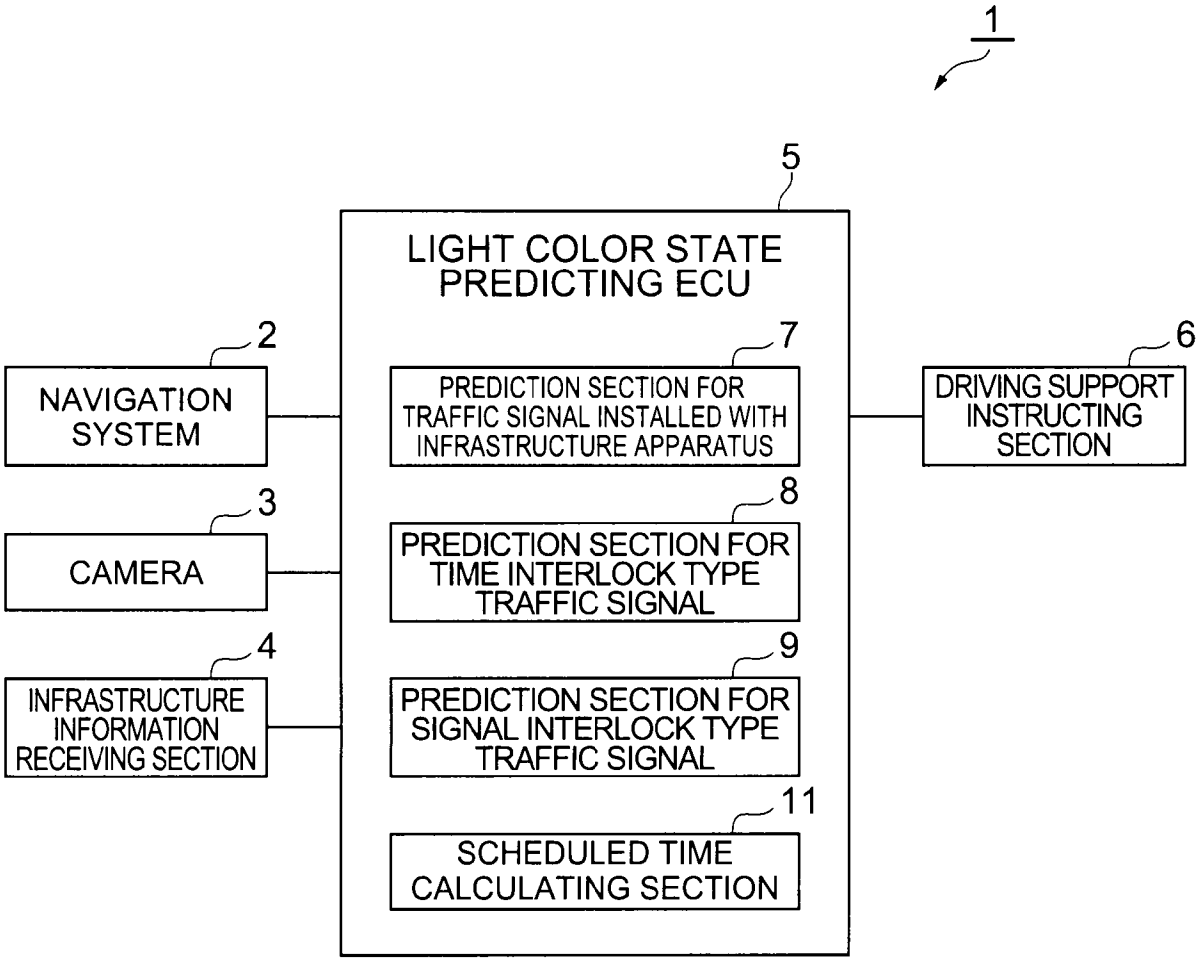
FIG. 1 is a block diagram showing the configuration of an embodiment of a driving supporting device related to the present invention.

6: driving support instructing section (driving support instructing means)

11: scheduled time calculating section (scheduled time calculating means)

12: light color state acquisition section (light color state acquisition means)

13: light color change cycle acquisition section (light color change cycle acquisition means)

14: light color state predicting section (light color state predicting means)

DESCRIPTION OF EMBODIMENTS

Hereinafter, preferred embodiments of the present invention will be described with reference to the drawings. Moreover, in each drawing, the same or corresponding sections are denoted by the same reference numerals and a repeated explanation will be omitted.

FIG. 1 is a block diagram showing the configuration of an embodiment of a driving supporting device related to the present invention. As shown in FIG. 1, a driving supporting device 1 includes a navigation system 2, a camera 3, an infrastructure information receiving section 4, a light color state predicting ECU (Electronic Control Unit) 5, and a driving support instructing section (driving support instructing means) 6. The driving supporting device 1 is mounted in a vehicle, predicts the light color state of a traffic signal that the vehicle (that is, a vehicle in which the driving supporting device 1 is mounted) is due to pass, and gives an instruction to the vehicle so that a predetermined driving support operation is performed when the vehicle arrives at the traffic signal.

The navigation system 2 has a GPS receiving section, which detects the position of the vehicle by receiving an electric wave from a plurality of GPS (Global Positioning System) satellites, and the map data in which road structures, positions of facilities, and the like are stored. The navigation system 2 transmits the peripheral information of the vehicle, which includes a road where the vehicle travels, to the light color state predicting ECU 5 on the basis of the position of the vehicle and the map data.

The camera 3 is a camera fixed to the front of the vehicle, and images the front of the vehicle and transmits the image to the light color state predicting ECU 5. The infrastructure information receiving section 4 receives the infrastructure information transmitted from an infrastructure apparatus installed around the road where the vehicle travels and transmits predetermined information to the light color state predicting ECU 5.

The driving support instructing section 6 gives an instruction to the vehicle, on the basis of the light color state of the traffic signal predicted by the light color state predicting ECU 5, so that a predetermined driving support operation is performed when the vehicle arrives at the traffic signal. For example, when the light color state of the traffic signal predicted by the light color state predicting ECU 5 is red (color indicating stop), an instruction is issued to the vehicle so that the following driving support operation is performed. That is, an instruction is issued to a display device so that notification urging a stopping operation is performed for a driver of the vehicle or an instruction is issued to an accelerator device or a brake device so that the traveling speed of the vehicle is decreased.

The light color state predicting ECU 5 predicts the light color state of a traffic signal that the vehicle is due to pass and transmits the prediction result to the driving support instructing section 6. The light color state predicting ECU 5 is an electronic control unit including a CPU [Central Processing Unit], a ROM [Read Only Memory], a RAM [Random Access Memory], and the like and performs overall control of the driving supporting device 1. The light color state predicting ECU 5 forms a prediction section 7 for a traffic signal installed with an infrastructure apparatus, a prediction section 8 for a time interlock type traffic signal, a prediction section 9 for a signal interlock type traffic signal, and a scheduled time calculating section (scheduled time calculating means) 11 using software by loading an application program stored in the ROM onto the RAM and executing it using the CPU.

The scheduled time calculating section 11 calculates a scheduled time at which the vehicle arrives at a traffic signal whose light color state is to be predicted (hereinafter, referred to as a "prediction object traffic signal"). Specifically, the scheduled time calculating section 11 calculates a scheduled time, at which the vehicle arrives at the prediction object traffic signal, when the vehicle has passed through a reference position on the basis of a distance from a predetermined reference position to the prediction object traffic signal, a time at which the vehicle has passed through the reference position, an average vehicle speed, traveling history, and the like. Here, if the reference position is set too far ahead with respect to the prediction object traffic signal, driving support is not executed for a vehicle entering from the byroad between the prediction object traffic signal and the reference position. Accordingly, the reference position is not a fixed position, but all positions where the distance from the prediction object traffic signal is a predetermined distance may be set as the reference position.

In addition, the reference position is acquired by the latitude and the longitude obtained by GPS Satellites, the road alignment information (change point of a link and the like) that the navigation system 2 has, the road information such as a stop line of an intersection ahead or road paint, a distance to a prediction object traffic signal (timing at which the prediction object traffic signal has a fixed size on an image captured by the camera 3), and the like. In addition, the distance from the reference position to the prediction object traffic signal is acquired by the distance, which is calculated on the basis of the latitude and the longitude obtained by GPS satellites, mileage of the vehicle, and the like.

Figure 2:
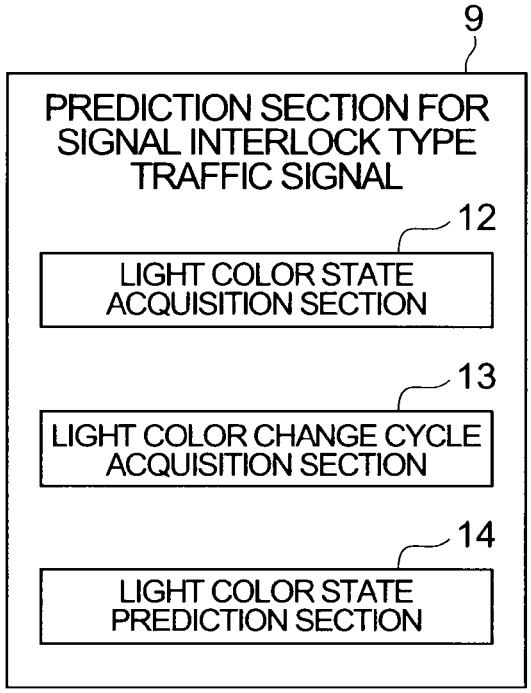
FIG. 2 is a block diagram showing the configuration of a prediction section for a signal interlock type traffic signal in FIG. 1.

FIG. 2 is a block diagram showing the configuration of the prediction section for a signal interlock type traffic signal in FIG. 1. As shown in FIG. 2, the light color state predicting ECU 5 forms a light color state acquisition section (light color state acquisition means) 12, a light color change cycle acquisition section (light color change cycle acquisition means) 13, and a light color state predicting section (light color state predicting means) 14 using software by loading an application program stored in the ROM onto the RAM and executing it using the CPU, thereby realizing the prediction section 9 for a signal interlock type traffic signal.

The light color state acquisition section 12 acquires the light color state of a traffic signal (hereinafter, referred to as a "prediction basis traffic signal") installed before the prediction object traffic signal. Specifically, the light color state acquisition section 12 receives an image transmitted from the camera 3 and acquires the light color state of the prediction basis traffic signal on the basis of the image of the prediction basis traffic signal captured by the camera 3 when the vehicle passes the prediction basis traffic signal.

Figure 3:
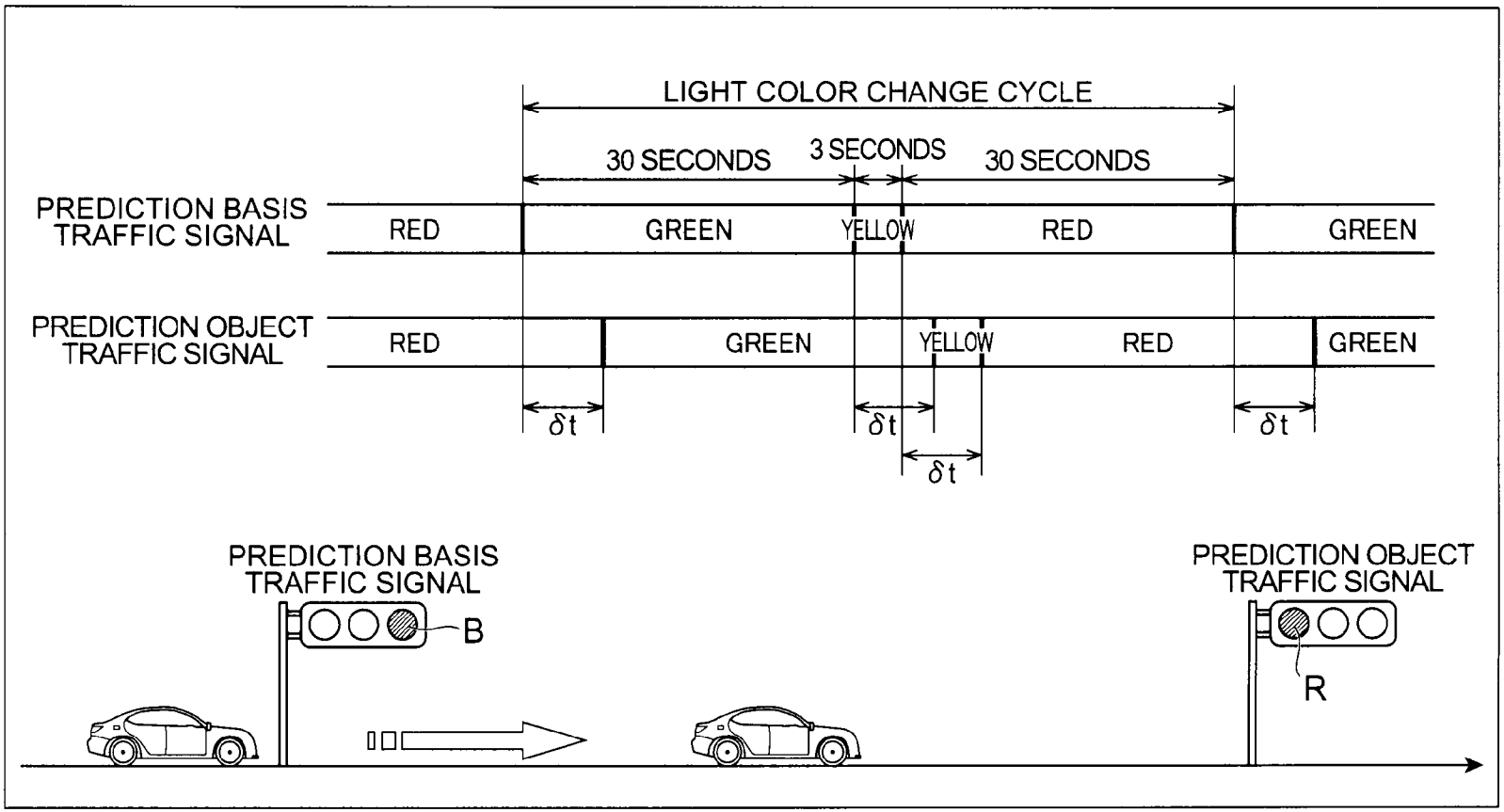
FIG. 3 is a view showing a scene where the driving supporting device in FIG. 1 is used.

The light color change cycle acquisition section 13 acquires the light color change cycle of a prediction object traffic signal on the basis of the light color change cycle of the prediction basis traffic signal. Specifically, the light color change cycle acquisition section 13 acquires the light color change cycle of the prediction object traffic signal on the basis of information regarding the time difference between the light color change cycle of the prediction basis traffic signal and the light color change cycle of the prediction object traffic signal (information indicating a time difference δt until, after the light color state of the prediction basis traffic signal changes, the light color state of the prediction object traffic signal similarly changes), as shown in FIG. 3. In addition, the light color change cycle of the prediction basis traffic signal and the time difference information may be acquired when the infrastructure information receiving section 4 receives the infrastructure information transmitted from an infrastructure apparatus installed in the prediction basis traffic signal or may be learned in advance and stored as a database in the light color state predicting ECU 5.

The light color state predicting section 14 predicts the light color state of the prediction object traffic signal when the vehicle arrives at the prediction object traffic signal (that is, a scheduled time calculated by the scheduled time calculating section 11) on the basis of the light color state of the prediction basis traffic signal acquired by the light color state acquisition section 12 and the light color change cycle of the prediction object traffic signal acquired by the light color change cycle acquisition section 13. For example, as shown in FIG. 3, when the light color time of green, yellow, and red of the object basis traffic signal and the object prediction traffic signal is 30 seconds, 3 seconds, and 30 seconds, respectively and the time difference δt is 10 seconds, the light color state predicting section 14 predicts that the light color state of the prediction object traffic signal will be red R assuming that the vehicle departs from the object basis traffic signal when the light color state of the object basis traffic signal changes from red R to green B and passes the object prediction traffic signal in 60 seconds from that point of time.

Figure 4:
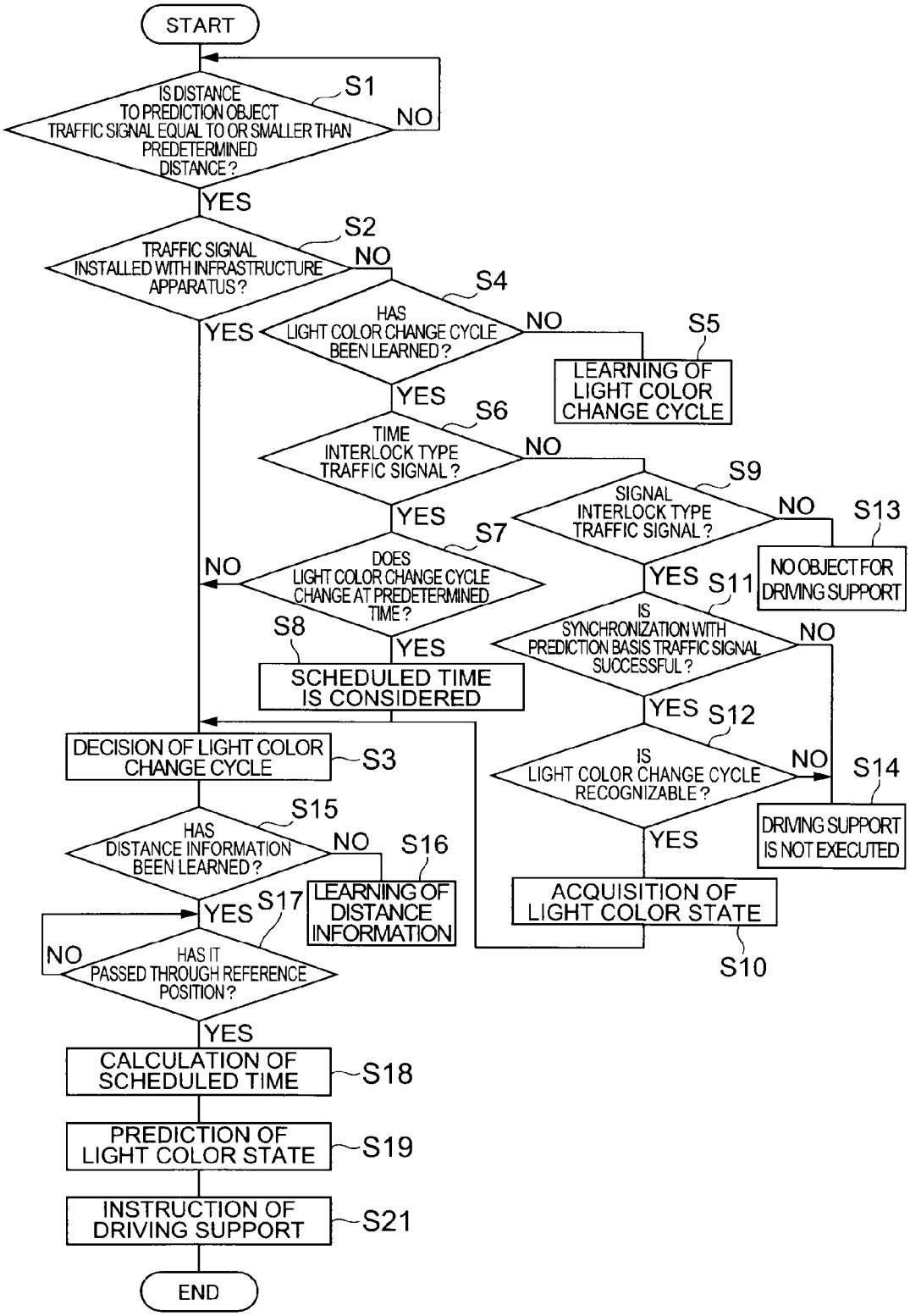
FIG. 4 is a flow chart showing the process executed by the driving supporting device in FIG. 1.

Next, a process executed by the driving supporting device 1 will be described with reference to FIG. 4. FIG. 4 is a flow chart showing the process executed by the driving supporting device in FIG. 1.

First, it is determined whether or not the distance to the prediction object traffic signal is equal to or smaller than a predetermined distance (S1). If it is equal to or smaller than the predetermined distance, it is determined whether or not an infrastructure apparatus is installed in the prediction object traffic signal (S2). As a result, if the infrastructure apparatus is installed, the infrastructure information transmitted from the prediction object traffic signal is received by the infrastructure information receiving section 4, and the light color change cycle of the prediction object traffic signal is decided by the prediction section 7 for a traffic signal installed with an infrastructure apparatus (S3). Thus, since the light color change cycle of the prediction object traffic signal is decided on the basis of the infrastructure information when the infrastructure apparatus is installed in the prediction object traffic signal, the capacity of information stored in the light color state predicting ECU 5 can be reduced.

If the infrastructure apparatus is not installed as a result of the determination in S2, it is determined whether or not the light color change cycle of the prediction object traffic signal has been learned (S4). As a result, if it has not been learned yet, the light color change cycle is learned and stored in the light color state predicting ECU 5 as a database (S5). Thus, by learning the light color change cycle of the prediction object traffic signal, updating to the new light color change cycle can be made when the light color change cycle of the prediction object traffic signal changes.

If the light color change cycle has been learned as a result of the determination in S4, it is determined whether or not the light color change cycle of the prediction object traffic signal is interlocked with a time (S6). As a result, if it is interlocked with a time, it is determined whether or not the light color change cycle changes at a predetermined time by the prediction section 8 for a time interlock type traffic signal (S7). If it changes at a predetermined time, a scheduled time at which the vehicle arrives at the prediction object traffic signal is taken into consideration (S8), and the light color change cycle of the prediction object traffic signal is decided (S3). For example, in the case where the light color change cycle changes at 16:30, assuming that the vehicle passes the prediction object traffic signal at a time after 16:30, the light color change cycle interlocked with the time after 16:30 is decided.

If it is not interlocked with a time as a result of the determination in S6, it is determined whether or not it is interlocked with the light color change cycle of another traffic signal (S9). As a result, if it is interlocked with the light color change cycle of another traffic signal, synchronization with the light color change cycle of the prediction basis traffic signal is made by the prediction section 9 for a signal interlock type traffic signal (S11). If the light color change cycle of the prediction object traffic signal is recognizable (S12), the light color state of the prediction basis traffic signal is acquired by the light color state acquisition section 12 of the prediction section 9 for a signal interlock type traffic signal (S10), and the light color change cycle of the prediction object traffic signal is decided by the light color change cycle acquisition section 13 of the prediction section 9 for a signal interlock type traffic signal (S3).

In addition, if it is not interlocked with the light color change cycle of another signal as a result of the determination in S9, it does not become an object for driving support (S13). Moreover, if synchronization could not be made as the respective results of determinations in S11 and S12, driving support is not executed when the light color change cycle is not recognizable (S14).

Subsequent to the decision (S3) of the light color change cycle of the prediction object traffic signal, it is determined whether or not the distance information (information indicating the distance from the predetermined reference position to the prediction object traffic signal) has been learned (S15). As a result, if it has not been learned yet, the distance information is learned and stored in the light color state predicting ECU 5 as a database (S16).

If distance information has been learned as a result of the determination in S15, it is determined whether or not it has passed through the reference position (S17). If it has passed through the reference position, a scheduled time at which the vehicle arrives at the prediction object traffic signal is calculated by the scheduled time calculating section 11 (S18). Subsequently, the light color state of the prediction object traffic signal at the scheduled time at which the vehicle arrives at the prediction object traffic signal is predicted by the prediction section 7 for a traffic signal installed with an infrastructure apparatus, the prediction section 8 for a time interlock type traffic signal, the light color state predicting section 14 of the prediction section 9 for a signal interlock type traffic signal (S19), and an instruction is issued to the vehicle by the driving support instructing section 6 so that a predetermined driving support operation is performed when the vehicle arrives at the prediction object traffic signal (S21).

As described above, in the driving supporting device 1, the light color state of the prediction basis traffic signal installed before the prediction object traffic signal is acquired by the light color state acquisition section 12, and the light color change cycle of the prediction object traffic signal is acquired on the basis of the light color change cycle of the prediction basis traffic signal by the light color change cycle acquisition section 13. In addition, by the light color state predicting section 14, the light color state of the prediction object traffic signal when the vehicle arrives at the prediction object traffic signal is predicted on the basis of the light color state of the prediction basis traffic signal and the light color change cycle of the prediction object traffic signal. Thus, since the light color change cycle of the prediction object traffic signal is acquired on the basis of the light color change cycle of the prediction basis traffic signal, it becomes possible to predict a light color state even in the case of a traffic signal which cannot transmit information indicating its light color change cycle.

In addition, the light color change cycle acquisition section 13 acquires the light color change cycle of the prediction object traffic signal on the basis of information regarding the time difference from the light color change cycle of the prediction basis traffic signal. Accordingly, when the light color state of the prediction object traffic signal changes in a state interlocked with the light color state of the prediction basis traffic signal, the light color change cycle of the prediction object traffic signal can be correctly acquired.

Moreover, since the scheduled time calculating section 11 calculates a scheduled time at which the vehicle arrives at the prediction object traffic signal and the light color state predicting section 14 predicts the light color state of the prediction object traffic signal at the scheduled time, the light color state of the prediction object traffic signal when the vehicle arrives at the prediction object traffic signal can be correctly predicted.

In addition, since the light color state acquisition section 12 acquires the light color state of the prediction basis traffic signal on the basis of an image of the prediction basis traffic signal captured by the camera 3 mounted in the vehicle, the light color state of the prediction basis traffic signal can be acquired easily and reliably.

In addition, the driving support instructing section 6 gives an instruction to the vehicle, on the basis of the light color state of the prediction object traffic signal which has been predicted by the light color state predicting section 14, so that a predetermined driving support operation is performed when the vehicle arrives at the prediction object traffic signal. Therefore, driving support when the vehicle arrives at the prediction object traffic signal can be appropriately realized.

The present invention is not limited to the embodiment described above.

Figure 5:
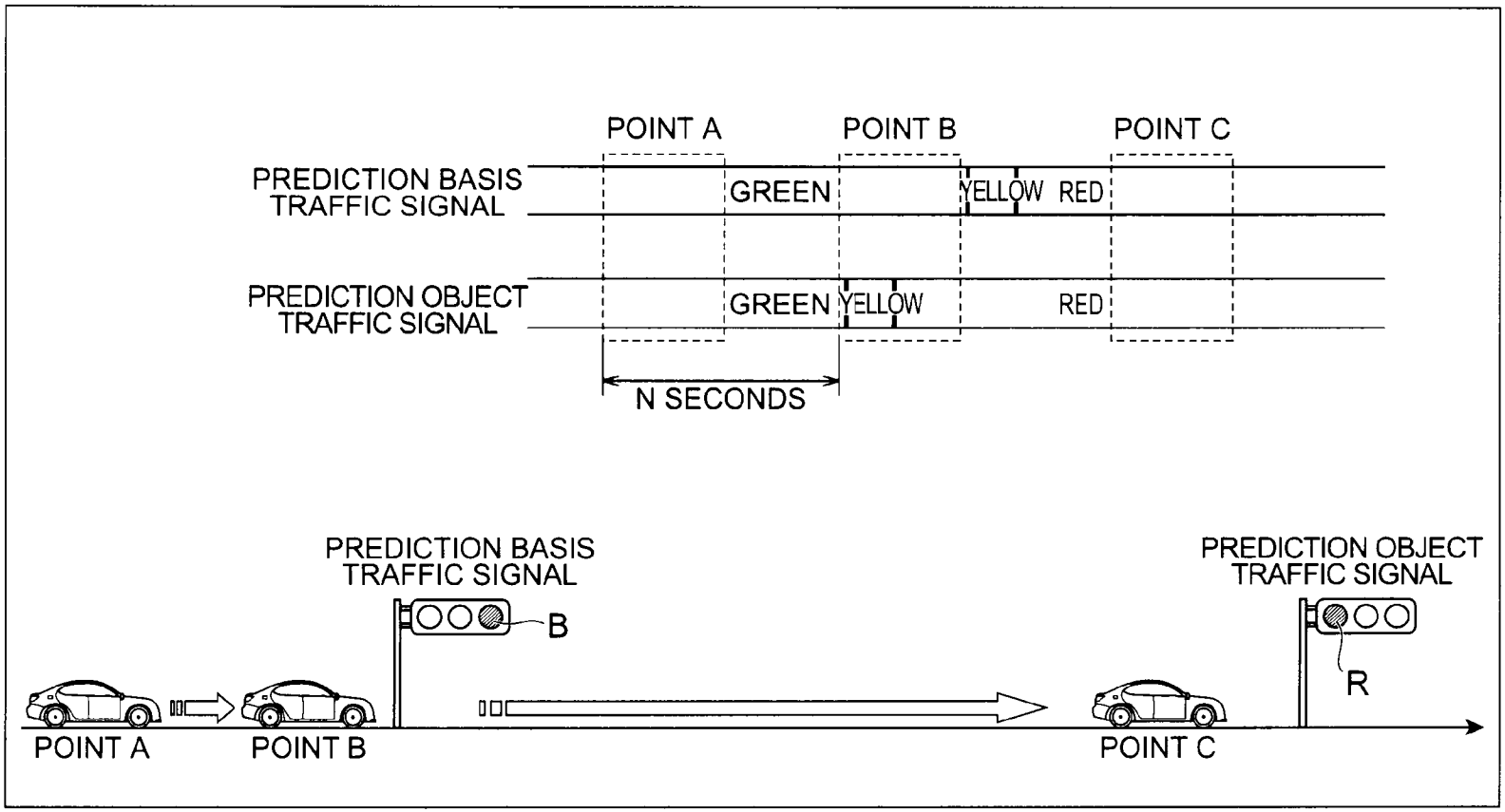
FIG. 5 is a view showing another scene where the driving supporting device in FIG. 1 is used.

For example, the light color state acquisition section 12 may acquire the light color state of the prediction basis traffic signal and the duration of the light color state, and the light color state predicting section 14 may predict the light color state of the prediction object traffic signal on the basis of the light color state of the prediction basis traffic signal and the duration of the light color state acquired by the light color state acquisition section 12 and the light color change cycle of the prediction object traffic signal acquired by the light color change cycle acquisition section 13. According to such a configuration, even if the light color state of the prediction basis traffic signal does not change when the vehicle passes the prediction basis traffic signal, the light color state of the prediction object traffic signal can be predicted. As an example, as shown in FIG. 5, in the case where it is recognized that the light color state of a prediction basis traffic signal when the vehicle passes through a point A is green B and it is recognized that the light color state of the prediction basis traffic signal will still be green B in N seconds when the vehicle passes through a point B where the prediction basis traffic signal is installed, the light color state of the prediction object traffic signal is predicted to be red R when the vehicle arrives at a point C where the prediction object traffic signal is installed.

In addition, each processing section in the light color state ECU 5 may be formed by hardware instead of software.

Industrial Applicability

According to the present invention, it is possible to predict a light color state even in the case of a traffic signal which cannot transmit information indicating its light color change cycle.

The invention claimed is:

1. A driving supporting device that predicts a light color state of a first traffic signal that a vehicle is due to pass, comprising:

light color state acquisition means for acquiring a light color state of a second traffic signal installed before the first traffic signal;

infrastructure information receiving section that receives a light color change cycle of the second traffic signal and information regarding a time difference of a light color change cycle of the first traffic signal from the light color change cycle of the second traffic signal from an infrastructure apparatus installed in the second traffic signal;

light color change cycle acquisition means for acquiring the light color change cycle of the first traffic signal on the basis of the light color change cycle of the second traffic signal and the information regarding the time difference received from the infrastructure receiving section; and light color state predicting means for predicting the light color state of the first traffic signal when the vehicle arrives at the first traffic signal on the basis of the light color state of the second traffic signal acquired by the light color state acquisition means and the light color change cycle of the first traffic signal acquired by the light color change cycle acquisition means.

2. The driving supporting device according to claim 1, further comprising:

scheduled time calculating means for calculating a scheduled time at which the vehicle arrives at the first traffic signal, wherein the light color state predicting means predicts the light color state of the first traffic signal at the scheduled time calculated by the scheduled time calculating means.

3. The driving supporting device according to claim 1, wherein the light color state acquisition means acquires the light color state of the second traffic signal and the duration of the light color state, and the light color state predicting means predicts the light color state of the first traffic signal on the basis of the light color state of the second traffic signal and the duration of the light color state acquired by the light color state acquisition means and the light color change cycle of the first traffic signal acquired by the light color change cycle acquisition means.

4. The driving supporting device according to claim 1, wherein the light color state acquisition means acquires the light color state of the second traffic signal on the basis of an image of the second traffic signal captured by a camera mounted in the vehicle.

5. The driving supporting device according to claim 1, further comprising:

driving support instructing means for giving an instruction to the vehicle, on the basis of the light color state of the first traffic signal predicted by the light color state predicting means, so that a predetermined driving support operation is performed when the vehicle arrives at the first traffic signal.

6. The driving supporting device according to claim 1, wherein the time difference is a time until, after the light color state of the second traffic signal changes, the light color state of the first traffic signal similarly changes.

* * * * *